US005911551A

United States Patent [19]

Moran

[11] Patent Number: 5,911,551

[45] Date of Patent: Jun. 15, 1999

[54] CONTAINERS

[75] Inventor: Peter Leslie Moran, Gloucestershire, United Kingdom

[73] Assignee: Carnaudmetalbox plc, United Kingdom

[21] Appl. No.: 08/790,305

[22] Filed: Jan. 28, 1997

Related U.S. Application Data

[62] Division of application No. 08/317,359, Oct. 4, 1994, abandoned.

[30] Foreign Application Priority Data

Jul. 20, 1994 [GB] United Kingdom ..... 9414643

[51] Int. Cl.[6] ..... B21D 51/26

[52] U.S. Cl. ..... 413/31

[58] Field of Search ..... 413/6, 7, 8, 9, 413/18, 19, 31, 34

[56] References Cited

U.S. PATENT DOCUMENTS 3,556,031 1/1971 Frankenberg .

5,049,019 9/1991 Franek et al. ..... 413/19

FOREIGN PATENT DOCUMENTS 0118201 2/1984 European Pat. Off. .

0177426 10/1985 European Pat. Off. .

OTHER PUBLICATIONS

European Search Report.

*Primary Examiner*—Joseph J. Hail, III

*Assistant Examiner*—Anthony Ojini

*Attorney, Agent, or Firm*—Diller, Ramik & Wight, PC

[57] ABSTRACT

A can end 50 is attached to a flange 16 of a can body 1 by means of a double seam. The radius $r_2$ of the seaming panel 55 of the can end is related to the radius $r_1$ of the body flange radius 17 by the formula $$r_2=r_1+t$$

where t is the thickness of the body flange. The benefit arising is that a longer body hook in the seam is achieved so that the overlap of body hook and can end is reliably increased so that reduced axial pressure may be used during formation of the double seam.

4 Claims, 4 Drawing Sheets

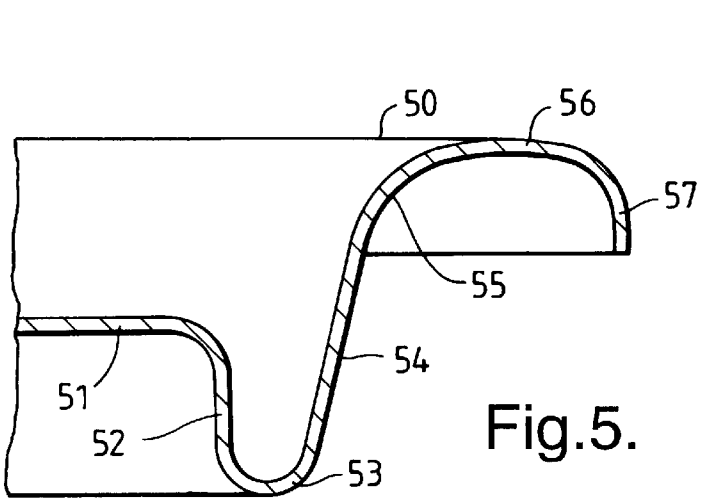
Fig.5.
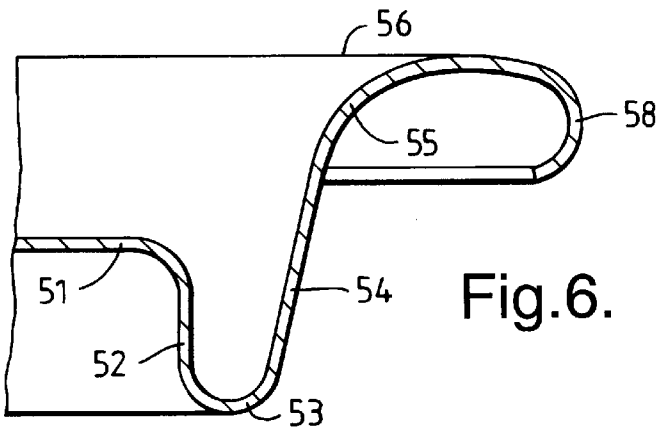
Fig.6.
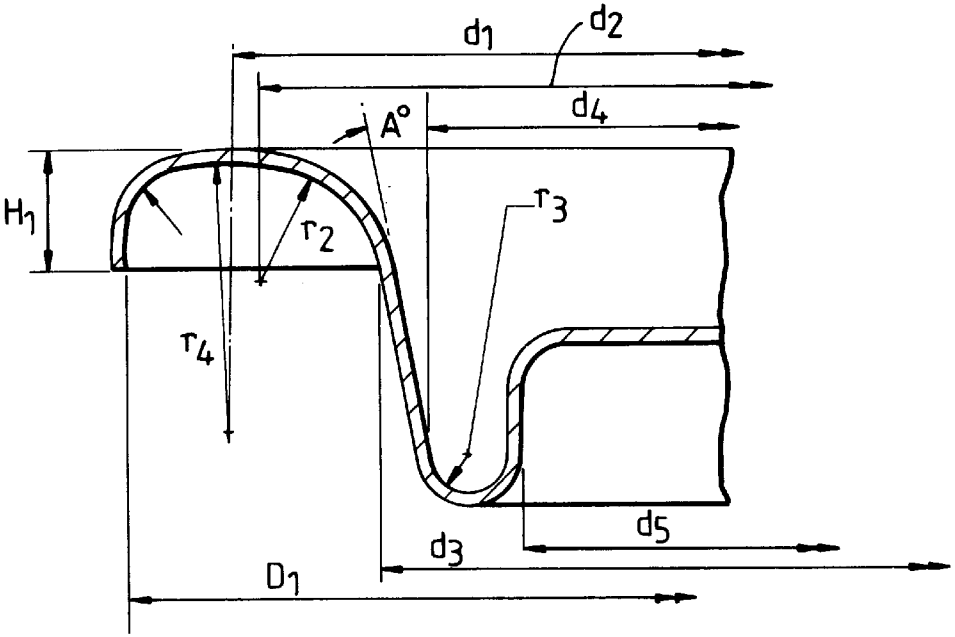
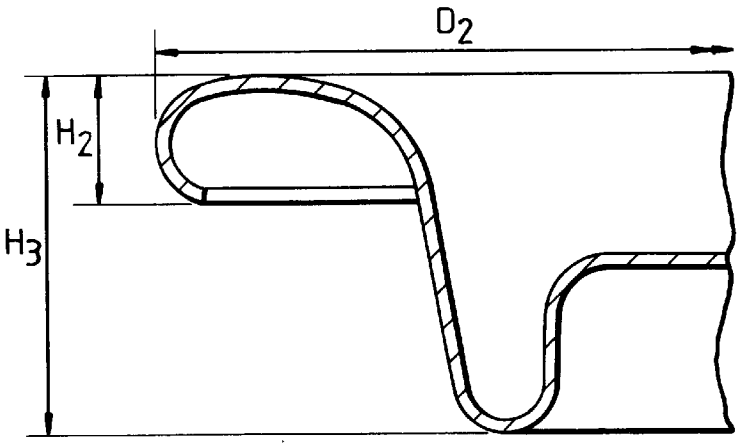

CONTAINERS

This application is a division of application Ser. No. 08/317,359, filed Oct. 4, 1994, now abandoned.

BACKGROUND OF THE INVENTION

This invention relates forming of a double seam between an end wall of a can and a body of a can and more particularly, but not exclusively to the forming of a double seam, of small dimensions, fixing a can end to a can end shell and can end permitting the drawn and wall ironed can body.

Wall ironed can bodies commonly have a bottom wall and an integral side wall upstanding from the periphery of the bottom wall to terminate in a shoulder, neck of reduced diameter, and an outwardly directed flange. It is usual for the majority of the side wall to be about half the thickness of the bottom wall so that work hardening is minimized to permit forming of the flange and double seam. An annulus of arcuate cross-section connects the neck to the flange a typical radius of this arcuate annulus is 0.050". Wall ironed can bodies are usually coated internally after forming by sprayed lacquer. Can ends fitted to these wall ironed can bodies are stamped from precoated sheet metal such as tinplate, electrochrome coated steel (TFS), or aluminium alloy so that hitherto the tightness of the contours of the can end have been limited by the limits of lacquer adhesion during stamping and the severity of the deformation in the press tool. When can bodies had a 206 diameter neck with 0.050" flange radius it was usual for the seaming panel radius of the can end to be 0.080" so that there was risk that a short overlap of cover hook and body hook arises on the double seam. The usual remedy was to increase base pressure to about 160 lbs on the can end during double seaming at risk of crushing the thin side wall of the can body.

For reasons of economy the can industry is now asked to provide cans with a neck diameter reduced to about 2" (50 mm) made with thinner side walls. There also arises a problem of designing a shaped can end that will permit formation of smaller double seams from thinner metal without risk of peripheral collapse to folds in the force edge of the can end.

SUMMARY OF THE INVENTION

Accordingly, in a first aspect this invention provides a method of making a double seam joining a can body to a can end, the can body having a cylindrical side wall of thin metal terminating in an outwardly directed flange joined to the side wall by a flange radius ($r_1$), the can end having a central panel, a chuck wall upstanding from the periphery of the centre panel, a seaming panel radius ($r_2$) extending outwardly from the chuck wall, a panel radius portion extending outwardly from the seaming panel radius, and a peripheral curl of externally convex cross-section surrounding the seaming panel radius, said method comprising the steps of:

a) supporting the can body, b) applying to the flange of the can body a can end, c) applying pressure to the can end by means of a chuck fitting in the chuck wall of the can end to centre the can end in the body flange, and a base load applied to the can, d) applying a first operation seaming roll to the peripheral curl of the can end to progressively form by relative rolling motion as between the can end and roll a first operation of the double seam, and e) applying a second operation seaming roll to the partly formed seam made in step (d) to form a completed double seam.

Characterised in that:

the can end applied in step (b) has a seaming panel radius ($r_2$) substantially equal to ($r_1$+t) where ($r_1$) is the radius of the body flange and (t) is the thickness of the metal from which the can end is made, and the top pressure applied in step (c) is less than 160 lbs.

In a second aspect this invention provides a can end shell comprising a centre panel, a chuck wall extending upwardly and outwardly from the periphery of the centre panel, a seaming panel radius turning outwardly from the chuck wall, a panel radius portion surrounding the seaming panel radius and a peripheral flange descending in a vertical direction from the seaming panel radius, herein the seaming panel radius $r_2$ is between 0.050" and 0.055" and said flange surrounds the seaming panel radius.

A third aspect this invention provide a can end made from the can end shell by curling the peripheral flange to an outwardly convex curl which surrounds the seaming panel radius.

In one embodiment the chuck wall is inclined at 12° to a vertical axis perpendicular to the centre panel and the chuck wall has a height on the order of 0.250"–0.270" (6.5 mm) measured along an axis perpendicular to the central panel. Preferrably the curl has a height, measured along said axis, greater than or equal to the radius $r_2$ of the seaming panel radius.

When the can end is fitted on a can body having a neck and flange connected by a flange of radius $r_1$ the flange radius and seaming panel radius are related by the equation $r_2=r_1+t$ where t is the thickness of the flange.

The benefits arising from this invention are that the prior art use of base lift pressure of 160 lbs applied towards a holding chuck can be reduced substantially so that thinner side walls may be used in the can bodies and better overlap of body hook and end hook are achieved in the double seam.

Various embodiments will now be described by way of example and with reference to the accompanying drawings in which,

BRIEF OF DESCRIPTION OF THE DRAWINGS

FIG. 5 is a side view sectioned on a diameter of a can end shell according to this invention;

FIG. 6 is a like view of the can end shell of FIG. 5 after peripheral curling;

DESCRIPTION OF THE PREFERRED EMBODIMENTS

Figure 1:
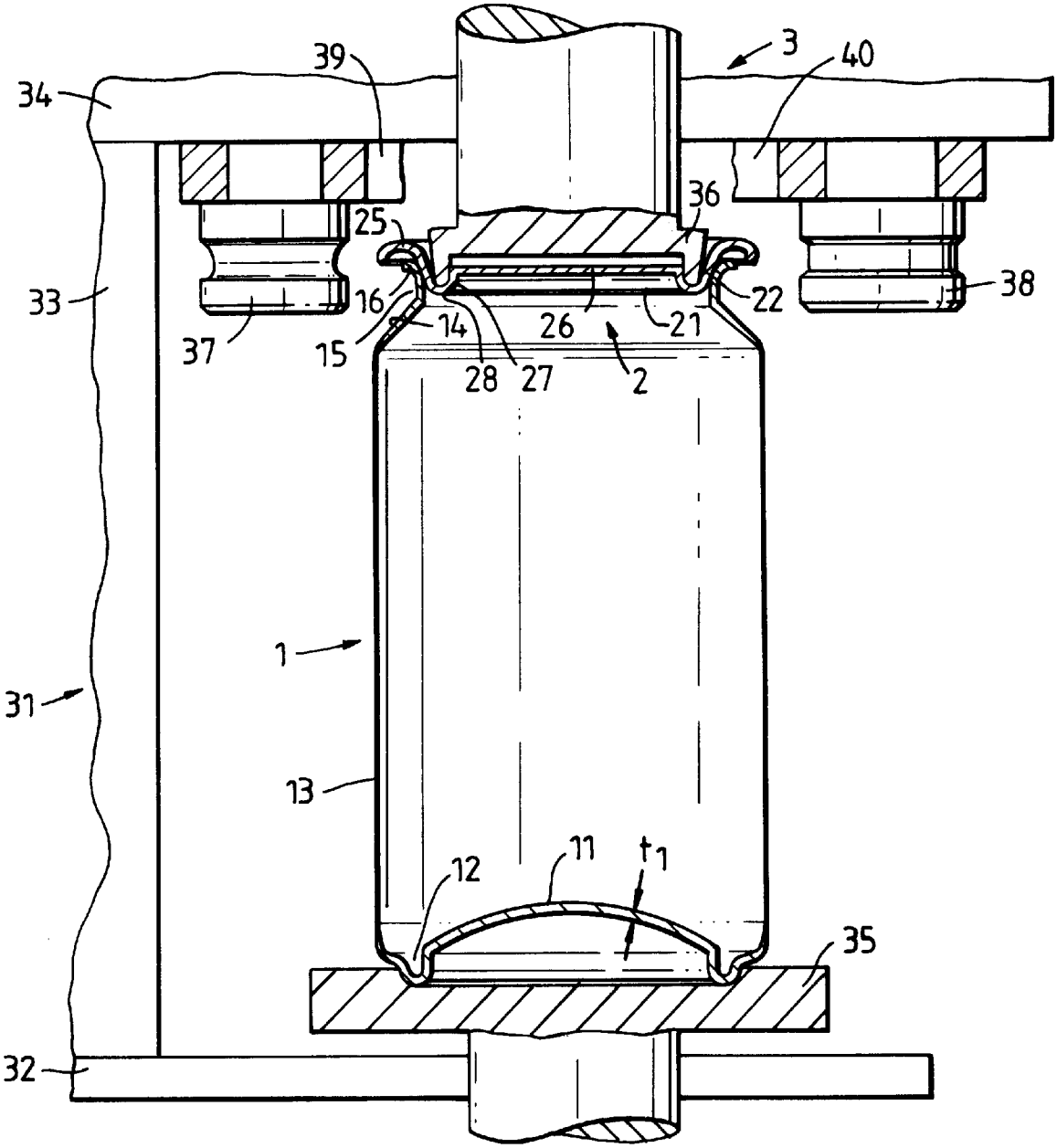
Fig.1. PRIOR ART
FIG. 1 is a diagrammatic sketch of apparatus for forming a double seam joining a can end to a can body.

FIG. 1 shows a wall ironed can body 1 with a can end 2 located on the can body in readiness for forming a double seam using forces available from the apparatus 3 shown or known apparatus working on the same principles.

Figure 2:
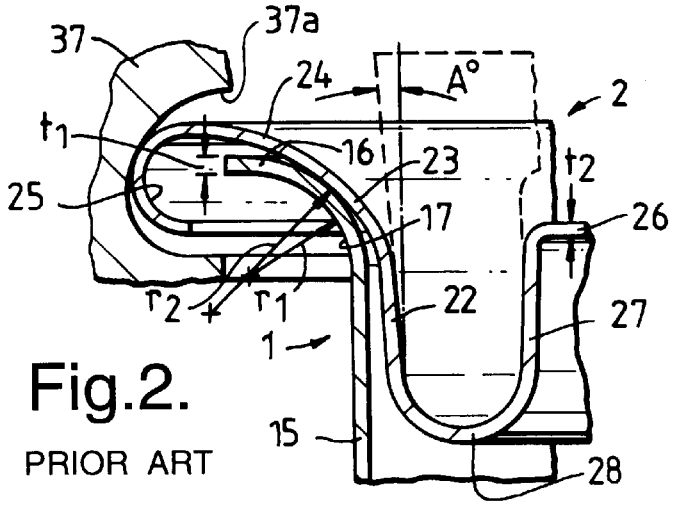
Fig.2. PRIOR ART
FIG. 2 is a fragmentary section of can end and can body flange before formation of a double seam.

In FIG. 1 the can body has been drawn and wall ironed form a single metal blank of thickness to comprise a domed bottom wall 11 including a stand bead 12, a side wall 13 thinner than the bottom wall extending from the periphery of the bottom wall to a shoulder portion 14 which extends inwardly and upwardly to a neck 15 of reduced diameter terminating in an outwardly extending flange 16 joined to the neck by a flange radius 17 of radius $r_2$ best seen in FIG. 2.

Typically the can body is drawn from a circular blank tinplate 0.010" thick or of aluminium alloy 0.12" thick.

The thinnest part of the side wall is usually about half the thickness of the bottom wall. The side wall thickness increases in the shoulder 14 to a thickness $t_1$ about 0.008" in the neck and flange. The flange radius $r_2$ is typically 0.050". Such can bodies are widely used for the packaging of beverages.

The can end 2 was drawn from a coated sheet metal blank to comprise a centre panel 21, a chuck wall 22 upstanding from the periphery of the centre panel, a seaming panel radius 23 (dimensioned $r_2$ in FIG. 2) tending outwardly from the seaming panel radius, and a peripheral curl 25 Of externally convex cross-section surrounding the sealing panel radius. As shown, the centre panel has a raised centre panel portion 26, a panel wall 27 depending from the periphery of the central panel portion, and a reinforcing bead 28 which joins the panel wall to the chuck wall 22. Such can ends are commonly used to close can bodies containing carbonated beverages. Whilst described with reference to beverage cans and can ends this invention relates to improvements in the double seam which may be alternatively used for food cans in which he centre panel comprises concentric expansion panels (not shown). Beverage can ends are typically formed from aluminium alloy sheet about (0.010") thick ($t_2$) or tinplate or TFS about 0.009" thick.

In FIG. 1 the apparatus 3 for forming a double seam has a frame 31 comprising a base plate 32, an upright portion 33 upstanding from the base plate, and a top plate 34 extending over tie base plate. A lifter pad 35 is slidably mounted in the base plate 32 and, as shown, supports the can body 1 in axial alignment with a chuck 36 slidably mounted on the top plate 34, and at the level of the seam forming profiles of a first operation roll 37 and a second operation roll 38.

Figure 3:
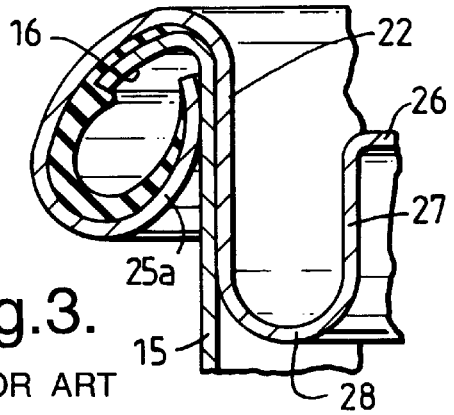
Fig.3. PRIOR ART
FIG. 3 is a fragmentary section of the can end and can body flange of FIG. 2 after forming of a first forming operation of the double seam.

The first operation roll 37 is mounted for free rotation on a lever 39 which is driven by a cam (not shown) to bring the roll 37 into engagement with the can end to form a first operation seam shown in FIG. 3. The second operation roll 38 is mounted for free rotation an a lever 40 which is driven by a cam (not shown) to bring the second operation roll 38 into engagement with the first operation seam of FIG. 4. In some double seaming apparatus the can body and end rotate as the rolls 37, 38 progressively form the double seam. In other double seaming apparatus the can body and can end remain stationary as the rolls are rotated round the can body. In other double seaming apparatus fixed rails are used instead of rolls. Therefore the forces available to form a double seam by relative rolling motion as between the can end on a can body and rolls or rails are:

a) bottom pressure applied between the lifter pad and chuck, to centre the can end firmly on the body flange and;

b) lateral pressure applied in an inwardly radial direction by the rolls or rail.

FIG. 2 shows a known form of can end 2 and can body 1 at the start of forming a double seam. The chuck 36 is applying a frictional drive on the can end to hold it firmly on the flange radius 17 which has a radius $r_1$ of about 0.050" (-mm). During wall ironing of the can body the metal of the neck and flange is ironed and finished by necking to about 0.007" thick so that application of excessive top pressure to the can end puts the body neck and flange at risk of a hoop stretching force as the exterior surface of the can end is pushed firmly onto the body flange radius 17.

Figure 4:
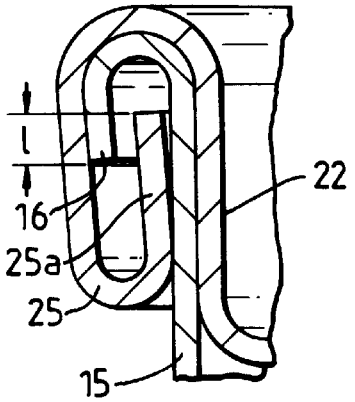
Fig.4. PRIOR ART
FIG. 4 is a fragmentary section of the can end and can body flange of FIG. 2 after formation of a double seam.

The can end 2 is shown making an annular line of contact in the seaming panel radius 23 with the body flange radius 17. Lining compound present in the can ends is omitted from FIG. 2 so the geometry is clear. Typically the radius $r_2$ of the seaming panel radius 23 is about 0.080" (0. mm) because hitherto known lacquers, used to coat the product side of the can ends, would not tolerate forming of tighter radius. Therefore the frustoconical chuck wall 22 inclined at an angle A°, typically 12°, is supported by the frustoconical wall of the chuck at a level below the level of the seaming rolls As the first operation roll 37 shown in FIG. 2 moves inwards to progressively form the first operation seam (part formed double seam) shown in FIG. 3 the upper inclined portion 37*a* of the profile progressively pushes the curl 25 downwards and inwards to interlock end material with the body flange of the can. During this movement of the curl 25 the radius portion 24 moves down onto the body flange 16 at risk of the original annular line of contact being disturbed so that the body flange is not fully formed to the length necessary to achieve a satisfactory length of overlap of the body flange and curl extremity or coverhook 25*a*. FIG. 4 shows the unsatisfactory overlap arising when the seam operation roll 38 is applied to the partly formed seam of FIG. 3. In the past attempts to correct this short overlap required application of a greater base pressure to the can during double seaming. However, this brings a risk of distortion of the can body flange and a risk of crushing the thin side wall metal of the can body, so that maximum economy of metal usage in the body has not been exploited.

FIG. 5 shows one embodiment of the invention in the form of a can end shell as formed by a press tool to comprise a centre panel portion 51, an annular panel wall 52 dependent from the periphery of the centre panel portion, a reinforcing bead 53, extending outwardly from the panel wall, a chuck wall 54 extending upwardly from the outer periphery of the reinforcing bead at an angle A of 12°, a seaming panel radius 55 turning outwardly from the chuck wall, a panel radius portion 56 surrounding the seaming panel radius and a peripheral flange 57 of arcuate cross-section depending vertically from the seaming panel radius.

According to this invention the internal radius $r_2$ of the seaming panel radius 55 is equal to $r_1$+t where $r_1$ is the flange radius of the can body and t is the thickness the body flange. Choice of this smaller than usual radius brings two benefits:

i. the seaming panel radius of the can end makes a secure contact with the body flange radius with less risk of body flange spreading, and ii. the length of the outwardly flaring chuck wall is increased to receive an extended length of support from the chuck so extending support to the level of the seaming roll profiles. FIG. 6 shows the can end shell of FIG. 5 after the peripheral arcuate flange has been turned inwards to form an outwardly convex peripheral curl 58.

By way of example, typical dimensions for the nominally 202 diameter shell shown in FIG. 5 are:

$D_1$ maximum diameter 2.282" (57.96 mm)

$d_1$ diameter at panel radius centre 2.120 (53.85 mm)

$d_2$ diameter at seaming panel radius centre 2.070 (52.58 mm).

$d_3$ maximum diameter of chuck wall 1.954" (49.63 mm) perpendicular height of chuck wall contact 0.2492" (6.3 mm)

$d_4$ minimum diameter of chuck wall 1.901 (48.26 mm)

$d_5$ centre panel wall diameter 1.774" (45.06 mm)

$r_2$ radius of the seaming panel; 0.050" to 0.055"

$r_3$ radius of reinforcing bead 0.019" (0.48 mm)

$r_4$ panel radius 0.219"

$H_1$ flange height 0.065" (1.67 mm)

$H_3$ overall height of can end

During curling of the peripheral flange 57 the overall diameter is reduced to $D_2$ to create a curl 58 of perpendicular height $H_2$ where $D_2$ is 2.235±0.010 diameter and the curl height $H_2$ is between 0.080" and 0.086" (2.03 to 2.18 mm) so that the curl 58 surrounds the entire height of the seaming panel radius 55. During curling the seaming panel radius may alter slightly to about 0.050". The rest of the dimensions of the can end of FIG. 6 are the same as the dimensions of the shell of FIG. 5.

Whilst the panel radius portion 56 is shown in FIG. 5 as being of arcuate cross section of radius $r_4$ this radius may be very large so that portion 56 would be substantially flat.

Figure 7:
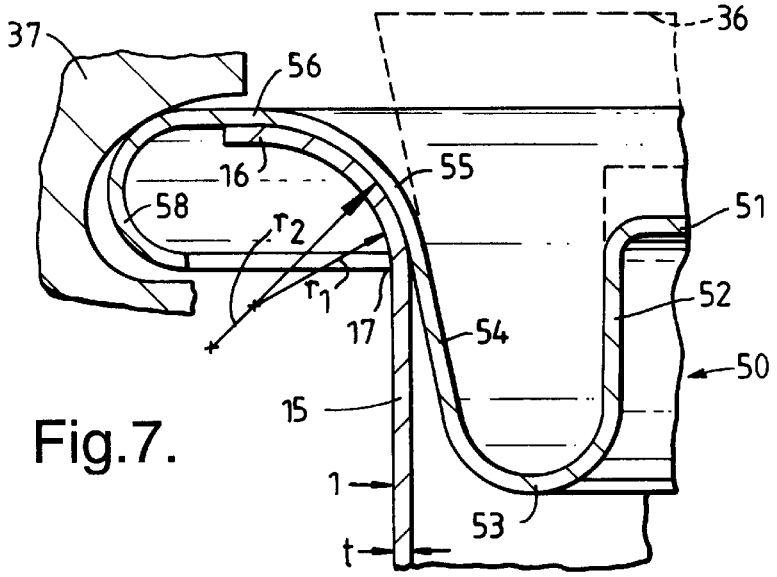
FIG. 7 is a fragmentary section of a can end and according to the invention.

FIG. 7 shows the can end 50 of FIG. 5 pressed onto the flange of a can body 1 by a chuck 36 as the first operation roll starts to form a first operation seam. The cylindrical neck and flange of the can body 1 are typically about 0.006" to 0.008" thick (t) and in this example the internal diameter of the neck is 1.968" (49 mm).

The body flange radius r, is about 0.050" (1.27 mm) so that the seaming panel radius 53 of the can end and body flange radius 17 are related by the formula $r_2=r_1+t$.

Comparing FIG. 7 with the prior art shown in FIG. 2 it will be seen that:

i. the panel radius portion 56 fits closely to the flange 16 in our FIG. 7 in contrast to the developing gap between the panel radius portion 24 and flange 16 in the portion art FIG. 2 so there is no lost motion closing the gap;

ii. the seaming panel radius 55 makes a concentric annular area of contact with the body flange radius 17 in contrast to the circular line of contact between the seaming panel radius 23 and body flange radius in FIG. 2 so that our contact of can end and body flange is secure without putting a spreading force on the body flange radius. A reduced base pressure of 130 lbs is sufficient to ensure correct contact during double seaming.

iii. the chuck wall 54 in FIG. 7 is longer than the chuck wall 22 in FIG. 7 because our usually small seaming panel radius $r_2$ does not encroach as much on the chuck wall length. This means the support provided by the exterior surface of the chuck 36 extends higher up to the level of the seaming roll profile.

Figure 8:
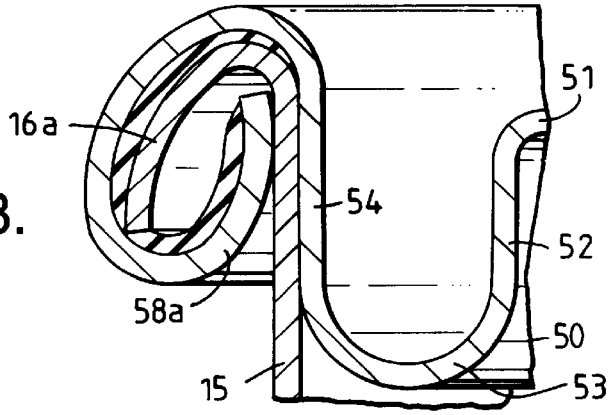
FIG. 8 is a fragmentary section of the can end and can body after the first operation of a double seam.

FIG. 8 shows a first operation seam (partly formed double seam) made by relative rolling motion as between the seaming roll 37 and can end 50 in FIG. 7. Comparing FIG. 8 with FIG. 3 of the prior art it will be seen that the flange 16 has been bent to a body hook 16a much longer in length, to the shape of a satisfactory first operation seam. The peripheral curl 58 has been formed into a end hook 58*a* reaching to touch the neck 15 and comprises a lining compound between the body hook 16*a* and end hook 58*a*.

Figure 9:
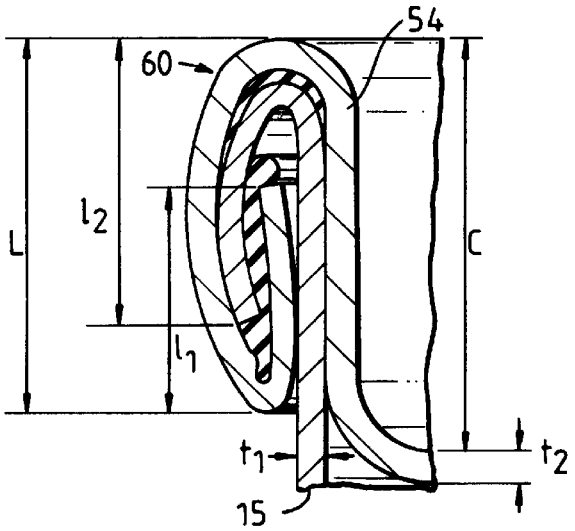
FIG. 9 is a fragmentary section of the final double seam.

Table 1 summarises a comparison of seaming ends in which prior art 202 diameter can ends with a seaming panel radius of 0.080" and 202 diameter can ends according to this invention with a seaming panel radius between 0.050" and 0.055" were double seamed to can bodies having a flange radius of 0.055 to make double seams of the shape shown in FIG. 9.

TABLE 1

| | Prior Art | According to this invention |
|---|---|---|
| r seaming panel radius $r_2$ | 0.080" | 0.050–0.055" |
| $l_1$ cover hook length | 0.063" | 0.063" |
| $l_2$ body hook length | 0.065" | 0.071" |
| $r_1$ body flange radius | 0.055" | 0.055" |
| $r_4$ panel radius | — | 0.219" |
| $t_1$ thickness of body flange | 0.0073" | 0.0073" |
| $t_2$ thickness of can end | 0.0088" | 0.0088" |
| base load used | 140 lbs | 140 lbs |

The additional body hook length of 0.005" achieved by this invention improves the percentage overlap and ensures that a target figure for body hook length, excess of 0.063, is reliably achieved. With this improved reliability of double seam shape we believe that can bodies may be made with a thinner side wall because base pressures can be reduced, for instance to 120 lbs or less.

FIG. 9 shows a completed double seam after application of a second operation roll to the first operation seam shown in FIG. 8.

In FIG. 9 the double seam 60 is compressed in radial width and elongated along the axis of the neck 15. Typically the seam length "L" is 0.100", the countersink depth "C" is 0.270", and the actual overlap is 0.040" so that small seams of thin metal ends and bodies may be seamed satisfactorily.

The lining compounds used are conventional, usually PVC compounds applied as plastisols or organosols applied in fluid form to the cured can end and then curled in situ.

The sheet metal, such as tinplate, electro chrome coated steel, (TFS) or aluminium alloy, from which our can end is made, is coated on at least the side presented to product in a can, with a lacquer such as an organosol, such as reference L 3E 692 available from Dexter Midland.

If required the external surface of the can end may be coated with lacquer such an epoxy lacquer. Alternatively the can ends may be stamped from a laminate of sheet metal and polymer films such as polypropylene, polyester or polyamide.

The reduced top pressure applied by the chuck in FIG. 7 permits use of can bodies with a thinner side wall such as 0.003 thick instead of 0.004.

Although a preferred embodiment of the invention has been specifically illustrated and described herein, it is to be understood that minor variations may be made in the apparatus without departing from the spirit and scope of the invention, as defined the appended claims.

I claim:

1. A method of making a double seam joining a metal can body to a metal can end comprising the steps of:

(a) providing a metal can body having a cylindrical side wall of thin metal terminating in an outwardly directed flange joined to the side wall by a flange radius ($r_1$);

(b) providing a metal can end having a centre panel, a chuck wall upstanding from the periphery of the centre panel a can end flange defined by a seaming panel radius ($r_2$) extending outwardly from the chuck wall, a panel radius portion extending outwardly from the seaming panel radius, and a peripheral curl of externally convex cross-section surrounding the seaming panel radius;

(c) supporting the metal can body;

(d) applying to the flange of the metal can body the metal can end;

(e) applying pressure to the metal can end by means of a chuck fitting in the chuck wall of the metal can end to centre the metal can end in the body flange;

(f) applying a first operation seaming tool to the peripheral curl of the metal can end to progressively form by relative rolling motion as between the metal can end and tool a first operation partially formed double seam;

(g) applying a second operation seaming tool to the partially formed double seams, made by the performance of applying the first operation seaming tool to the peripheral curl of the metal can end, to form a complete double seam, (h) said metal can end, having a seaming panel radius ($r_2$) substantially equal to ($r_1$+t) where ($r_1$) is the radius of the body flange prior to applying pressure to the metal can end by means of said chuck, ($r_2$) is the radius of the can end flange prior to applying pressure to the metal can end by means of said chuck, and (t) is the thickness of the metal from which the metal can end is made, the pressure applied by said chuck is less than 160 lbs, and (i) the double seam includes axially overlapped portions of said flanges as measured between terminal edges thereof having a substantially increased axial length as compared to overlapped portions of conventional double seams with attendant increased body flange length absent flange distortion and can body crush for any particular base pressure.

2. The method as defined in claim 1 wherein the pressure applied by said chuck is in the range between 160 lbs. and 140 lbs.

3. The method as defined in claim 1 wherein the pressure applied in by said chuck is in the range between 140 lbs. and 120 lbs.

4. The method as defined in claim 1 wherein the pressure applied by said chuck is less than 120 lbs.

* * * * *